US009642761B2

(12) United States Patent
Keisala

(10) Patent No.: US 9,642,761 B2
(45) Date of Patent: May 9, 2017

(54) PATIENT TABLE

(71) Applicant: Lojer Oy, Sastamala (FI)

(72) Inventor: Teuvo Keisala, Sastamala (FI)

(73) Assignee: Lojer Oy, Sastamala (FI)

( * ) Notice: Subject to any disclaimer, the term of this patent is extended or adjusted under 35 U.S.C. 154(b) by 0 days.

(21) Appl. No.: 14/937,323

(22) Filed: Nov. 10, 2015

(65) Prior Publication Data

US 2016/0128887 A1 May 12, 2016

(30) Foreign Application Priority Data

Nov. 10, 2014 (FI) ..... 20145982

(51) Int. Cl.
*A61G 13/04* (2006.01)
*A61G 7/005* (2006.01)

(52) U.S. Cl.
CPC ..... *A61G 13/04* (2013.01); *A61G 7/005* (2013.01)

(58) Field of Classification Search
CPC ..... A61G 7/002; A61G 7/005; A61G 7/012; A61G 7/018; A61G 13/02; A61G 13/04; A61G 13/06
USPC ..... 5/610, 601, 600
See application file for complete search history.

(56) References Cited

U.S. PATENT DOCUMENTS 5,345,632 A * 9/1994 Langenaeken ..... A61B 6/0457 108/4
2016/0128887 A1* 5/2016 Keisala ..... A61G 13/04 5/610

FOREIGN PATENT DOCUMENTS

AU 534 935 B2 2/1984
DE 201 20 104 U1 3/2002
EP 0 511 049 A1 10/1992

OTHER PUBLICATIONS

Extended European Search Report from Application No. 15193571.5; Dated: Mar. 29, 2016; Entitled: "Patient Table".

* cited by examiner

*Primary Examiner* — Robert G Santos
(74) *Attorney, Agent, or Firm* — Hamilton, Brook, Smith & Reynolds, P.C.

(57) ABSTRACT

A patient table includes a table top, lower frame and intermediate frame. The intermediate frame is arranged between the table top and the lower frame, and it is pivotally connected to the lower frame by a lower joint of the intermediate frame so as to pivot in relation to the lower frame and it is further pivotally connected to the table top by an upper joint of the intermediate frame so as to pivot in relation to the table top. The patient table also has a lower actuator, which at its lower end is pivotally connected to the lower frame by a lower joint of the lower actuator and at its upper end to the table top or the intermediate frame by an upper joint of the lower actuator, and an upper actuator, which at its lower end is pivotally connected to the lower frame or the intermediate frame by a lower joint of the upper actuator and at its upper end pivotally connected to the table top by an upper joint of the upper actuator. The lower joint of the lower actuator of the patient table is at a distance from the lower joint of the intermediate frame and the upper joint of the upper actuator is at a distance from the upper joint of the intermediate frame.

8 Claims, 2 Drawing Sheets

PATIENT TABLE

RELATED APPLICATION

This application claims priority under 35 U.S.C. §119 or 365 to Finland Application No. 20145982, filed Nov. 10, 2014. The entire teachings of the above application are incorporated herein by reference.

TECHNICAL FIELD

The invention relates to a patient table that may be e.g. a hospital bed, a patient bed, operating table, treatment table, medical examination table, mobilisation table, manipulation table, or some other patient table.

SUMMARY

An object of the invention is to provide a novel patient table.

The solution according to the invention is characterized by what is disclosed in the independent claims.

Some embodiments of the invention are disclosed in the dependent claims.

According to an embodiment, the patient table includes a table top, lower frame and intermediate frame. The intermediate frame is arranged between the table top and the lower frame, and it is pivotally connected to the lower frame by a lower joint of the intermediate frame so as to turn in relation to the lower frame and, further, to the table top by an upper joint of the intermediate frame so as to turn in relation to the table top. The patient table also has a lower actuator, which at its lower end is pivotally connected to the lower frame by a lower joint of the lower actuator and at its upper end to the table top or the intermediate frame by an upper joint of the lower actuator, and an upper actuator, which at its lower end is pivotally connected to the lower frame or the intermediate frame by a lower joint of the upper actuator and at its upper end to the table top by an upper joint of the upper actuator. The lower joint of the lower actuator of the patient table is at a distance from the lower joint of the intermediate frame and the upper joint of the upper actuator is at a distance from the upper joint of the intermediate frame.

A patient table such as this is extremely versatile and strong. The table top may be raised in a horizontal plane by driving both actuators outward and lowered in the horizontal plane by driving both actuators inward. The patient table may also be driven to Trendelenburg and reverse Trendelenburg positions by cross-driving the actuators, i.e. the lower actuator is driven inward and upper actuator outward, and vice versa.

According to an embodiment, the distance of the lower joint of the lower actuator from the lower joint of the intermediate frame is smaller than the length of the intermediate frame. According to yet another embodiment, the lower joint of the intermediate frame, the lower joint of the lower actuator and the lower joint of the upper actuator are at a horizontal distance from a first end of the lower frame that is less than half of the length of the lower frame. According to yet another embodiment, the distance in question is less than one third of the length of the lower frame. These kinds of solutions provide efficient means for avoiding tensile stress on the actuators during use of the patient table.

According to an embodiment, the upper joint of the lower actuator is in each position of use further away from the first end of the lower frame, when seen in a horizontal direction, than the lower joint of the lower actuator, the upper joint of the upper actuator is further away from the first end of the lower frame, when seen in the horizontal direction, than the lower joint of the upper actuator, and the upper joint of the intermediate frame is further away from the first end of the lower frame, when seen in the horizontal direction, than the lower joint of the intermediate frame. The patient table is thus sturdy and tensile stress on the actuators can be avoided particularly well.

BRIEF DESCRIPTION OF THE DRAWINGS

Some embodiments of the invention are described in greater detail in the attached drawings, in which.

For the sake of clarity, the figures show some embodiments of the invention in a simplified manner. In the figures, like reference numerals identify like elements.

DETAILED DESCRIPTION

Figure 1:
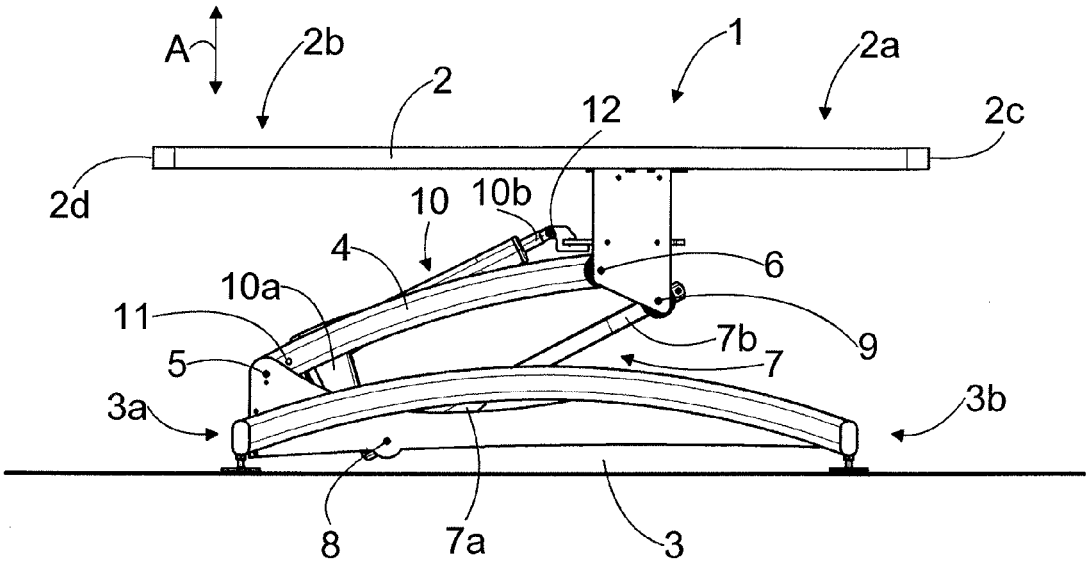
FIG. 1 is a schematic side view of a patient table in a horizontal position.

FIG. 1 shows a patient table 1. The patient table 1 may be e.g. a hospital bed, a patient bed, operating table, treatment table, medical examination table, mobilization table, manipulation table, or some other patient table.

The patient table 1 includes a table top 2, lower frame 3 and intermediate frame 4. The table top 2 may comprise e.g. hand rests, head rests or some other interconnected parts that may be adjustable in relation to one another. For the sake of clarity, these parts are not, however, separately shown in the accompanying figures.

The lower frame 3 may be a uniform structure or composed of different interconnected parts as shown in the accompanying figures, for example.

The intermediate frame 4 is arranged between the table top 2 and the lower frame 3. The intermediate frame 4 is pivotally connected to the lower frame 3 by a lower joint 5 of the intermediate frame so as to turn in relation to the lower frame 3. The intermediate frame 4 is further pivotally connected to the table top 2 by an upper joint 6 of the intermediate frame so as to turn in relation to the table top 2. The intermediate frame 4 is a rigid structure. The intermediate frame 4 may be a fork structure between the table top 2 and the lower frame 3. The intermediate frame 4 may have a duplicate structure, for example, with two arms in the intermediate frame, between the lower joint 5 and the upper joint 6 of the intermediate frame. The intermediate frame 4 is provided with only one lower joint 5 and only one upper joint 6 and an arm or a set of arms between the lower joint 5 and the upper joint 6.

The patient table 1 is further provided with a lower actuator 7. The lower end of the lower actuator 7 is pivotally connected by a lower joint 8 of the lower actuator to the lower frame 3. The upper end of the lower actuator 7 is pivotally connected by an upper joint 9 of the lower actuator to the table top 2. The lower joint 8 of the lower actuator is at a distance from the lower joint 5 of the intermediate frame. In the embodiment of FIG. 1 the upper joint 9 of the lower actuator is placed in association with the table top 2 and at a distance from the upper joint 6 of the intermediate frame. However, the upper joint 9 of the lower actuator and the upper joint 6 of the intermediate frame could also be the same. In addition, the upper joint 9 of the lower actuator could be placed to the intermediate frame 4, if desired.

The patient table 1 also has an upper actuator 10. The lower end of the upper actuator 10 is pivotally connected to the intermediate frame 4 by a lower joint 11 of the upper actuator at a distance from the lower joint 5 of the intermediate frame. If desired, the lower joint 11 of the upper actuator could be arranged to coincide with the lower joint 5 of the intermediate frame or placed to the lower frame 3 at a distance from the lower joint 5 of the intermediate frame. The upper end of the upper actuator 10 is pivotally connected to the table top 2 by an upper joint 12 of the upper actuator. The upper joint 12 of the upper actuator is at a distance from the upper joint 6 of the intermediate frame.

As shown in the figure, the lower joint 8 of the lower actuator and the lower joint 11 of the upper actuator may both be at a distance from the lower joint 5 of the intermediate frame and on the same side of the lower joint 5 of the intermediate frame. This makes the structure sturdy. If, in addition, the lower joint 11 of the upper actuator is arranged to the lower frame 3, both the lower actuator 7 and the upper actuator 10 may be used for moving the intermediate frame 4 and the table top 2.

In the embodiments of the accompanying figures, the upper joint 6 of the intermediate frame, the upper joint 9 of the lower actuator and the upper joint 12 of the upper actuator are thus all arranged in connection with the table top 2. In that case, the movements of both the lower actuator 7 and the upper actuator 10 act directly on the movement of the table top 2, i.e. they do not act on the movement of the table top through the intermediate frame 4. In addition, the upper joint 6 of the intermediate frame, the upper joint 9 of the lower actuator and the upper joint 12 of the upper actuator are fixedly arranged in relation to one another, i.e. their mutual distance remains the same in all positions of use of the patient table.

All the lower joints 5, 8, 11 and all the upper joints 6, 9, 12 are non-slidingly arranged to the patient table structure.

The lower actuator 7 and the upper actuator 10 may be electric actuators. In that case lower actuator 7 comprises a motor part 7*a* and a motion arm 7*b* that the motor part 7*a* is configured to move. Correspondingly, the upper actuator 10 comprises a motor part 10*a* and a motion arm 10*b* that the motor part 10*a* is configured to move. The lower actuator 7 and the upper actuator 10 may be spindle motors, the motion arm 7*b* and, correspondingly, the motion arm 10*b* then being spindles of the spindle motor.

Since the lower joint 8 of the lower actuator is at a distance from the lower joint 5 of the intermediate frame, the upper end of the intermediate frame 4 and, consequently, the table top 2 rise when the lower actuator 7 is driven outward. Correspondingly, when the lower actuator 7 is driven inward, the upper end of the intermediate frame 4 and, consequently, the table top 2 descend.

If only the lower actuator 7 is driven, but not the upper actuator 10, the end of the table top 2 on the upper joint 9 side of the lower actuator rises when the lower actuator 7 is driven outward and, correspondingly, descends when the lower actuator 7 is driven inward. Hence, when the table top is raised and lowered by driving the lower actuator 7, this must be taken into account in the driving of the upper actuator 10 so that the turning or, when desired, non-turning of the table top 2 may be controlled. When the upper joint 12 of the upper actuator is at a distance from the upper joint 6 of the intermediate frame, driving of the upper actuator 10 causes the table top 2 to turn in relation to the intermediate frame 4. The table top 2 turns about the upper joint 6 of the intermediate frame. Hence the control of the actuators 7 and 10 is synchronized to be as desired. The actuators 7 and 10 are driven by a control unit, which is not shown in the attached figures for the sake of clarity.

Since the upper joint 9 of the lower actuator in the table top 2 is at a distance from the upper joint 6 of the intermediate frame, driving of the lower actuator 7 also has an effect on the turning of the table top 2 in relation to the intermediate frame 4.

Since both the upper joint 9 of the lower actuator and the upper joint 12 of the upper actuator are at a distance from the upper joint 6 of the intermediate frame and both actuators thus act on the turning of the table top 2, the table top may be controlled in a diversified manner as disclosed below. In addition, this solution and the geometry to be described later make it possible to keep the actuators under pressure in the operating range of the patient table.

When the table top 2 is to be raised in horizontal position, for example, both the lower actuator 7 and the upper actuator 10 are driven outward. Then again, when the table top 2 is to be lowered in horizontal position, the lower actuator 7 and the upper actuator 10 are driven inward. The table top 2 may thus be raised and lowered as illustrated by the two-headed arrow A in FIG. 1.

Figure 2:
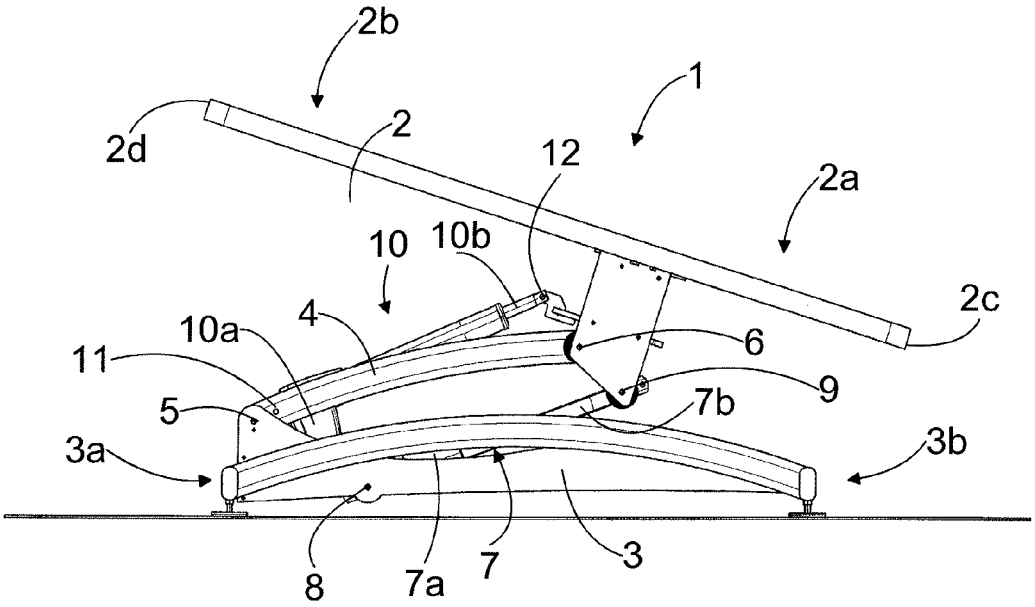
FIG. 2 shows the patient table of FIG. 1 with the head section lowered.

In certain situations the table top 2 is to be tilted so that the patient's head is lower down than the rest of the body. This is also referred to as the Trendelenburg position. This position is shown in FIG. 2. In other words, the table top 2 is tilted so that the head section 2*a* is lower down. The table top 2 may be driven to this position by cross-driving the actuators 7 and 10, i.e. the lower actuator 7 is driven inward and upper actuator 10 outward.

Figure 3:
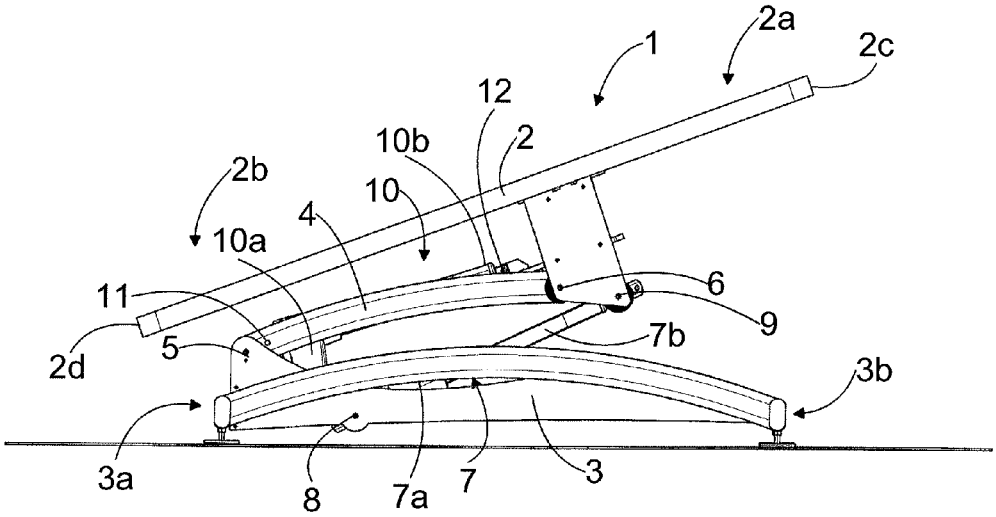
FIG. 3 is a schematic view of the solution of FIG. 1 with the foot section lowered.

There are also certain situations in which the table top 2 is to be tilted so that the patient's feet are lower down than the rest of the body. In other words, the foot section 2*b* of the table top 2 is lower down. This position is shown in FIG. 3 and it is also referred to as a reverse Trendelenburg position. The table top 2 may be driven to this position by cross-driving the actuators 7 and 10, i.e. the lower actuator 7 is driven outward and upper actuator 10 inward.

Figure 4:
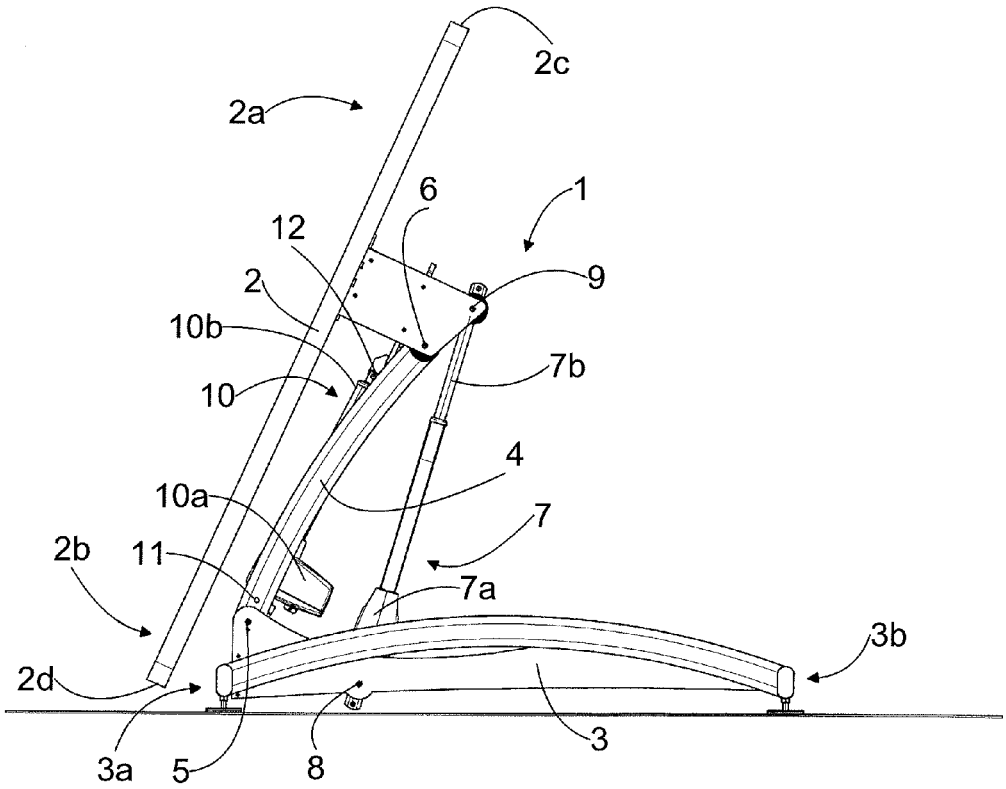
FIG. 4 is a schematic view of the solution of FIG. 1 in an extreme position with the foot section lowered.

When the lower actuator 7 continues to be driven outward and the upper actuator 10 inward all the way to their extreme positions, the table top 2 can be driven to a fairly steep angle, as illustrated in FIG. 4. The extreme position in FIG. 4 may also be described as the position for taking the patient onto the patient table. The patient may thus set onto the table top in an almost vertical position. The table top is then gradually lowered toward a more horizontal position and for this purpose the actuators 7 and 10 are cross-driven by driving the lower actuator 7 inward and upper actuator 10 outward.

If the upper joint 9 of the lower actuator 7 were arranged to the intermediate frame 4 or to coincide with the upper joint 6 of the intermediate frame, the driving of the lower actuator 7 would have no effect on the turning of the table top 2 in relation to the upper joint 6 of the intermediate frame. On the other hand, if the lower joint 11 of the upper actuator 10 were arranged to the lower frame 3 at a distance from the lower joint 5 of the intermediate frame, the driving of the upper actuator 10 would have an effect on the rising of the upper end of the intermediate frame 4, i.e. on the turning of the end in relation to the lower joint 5 of the intermediate frame.

The lower actuator 7 has an effect at least on the turning of the intermediate frame 4 in relation to the lower joint 5 of the intermediate frame. The upper actuator 10 has an effect at least on the turning of the table top 2 in relation to the upper joint 6 of the intermediate frame.

Consequently, different points of positioning the joints must be taken into account in a synchronized control of the actuators 7 and 10.

The lower joint 8 of the lower actuator is at a distance from the lower joint 5 of the intermediate frame. On the other hand, this distance is shorter than the length of the intermediate frame, i.e. the distance of the lower joint 5 of the intermediate frame from the upper joint 6 of the intermediate frame.

The lower frame 3 has a first end 3*a* and a second end 3*b*. According to an embodiment, the lower joint 5 of the intermediate frame, the lower joint 8 of the lower actuator and the lower joint 11 of the upper actuator are at a horizontal distance from a first end 3*a* of the lower frame 3 that is less than half of the length of the lower frame 3. According to yet another embodiment, the length of the intermediate frame 4, i.e. the distance of the lower joint 5 of the intermediate frame from its upper joint 6 is more than half of the length of the lower frame 3. According to still another embodiment, the lower joint 5 of the intermediate frame, the lower joint 8 of the lower actuator and the lower joint 11 of the upper actuator are at a horizontal distance from the first end 3*a* of the lower frame that is less one third of the length of the lower frame 3. Because of this structure, the intermediate frame 4, the lower actuator 7 and the upper actuator 10 are tilted in the same direction, which enables tensile stress or traction force on the lower actuator 7 and the upper actuator 10 to be avoided.

The treatment table disclosed here is formed so that when in its range of operation and under a predetermined maximum load the table top 2 will not tip. In other words, a force directed to the table top 2 area from above will not cause the patient table to tip over. The maximum load takes into account the weight of the table top and, on the other hand, a specific standard load that a patient is considered to impose on the table top 2. On the other hand, the topmost and lowermost positions of the table top are determined for the operating range of the patient table in horizontal, Trendelenburg and reverse Trendelenburg positions. In addition, a maximum tilt angle for the Trendelenburg position and, correspondingly, a maximum tilt angle for the reverse Trendelenburg position are determined. Also corresponding values for the position in which a patient is taken onto the patient table are determined.

The weight of the table top 2 and, on the other hand, that of the patient on the table top 2 cause a downward acting force that presses the lower actuator 7 and the upper actuator 10 inward. The effect of weight acting on either table top end, i.e. the head section 2*a* or the foot section 2*b*, with the weight of the table top included, must be greater downward on the upper joints 6, 9 and 12 than the leverage of the weight in question upwards on the joint positions concerned. Hence the effect of the lever arm may not be so great as to cause an upward force at the upper joint 6 or a traction force in the actuators 7 and 10.

In the disclosed solution the distance between the upper joint 9 of the lower actuator and the upper joint 12 of the upper actuator is at least ¼, preferably at least ⅓ of the distance between the upper joint 9 of the lower actuator and the end 2*c* of the head section of the table top. Correspondingly, the distance between the upper joint 9 of the lower actuator and the upper joint 12 of the upper actuator is at least ⅕, preferably at least ¼, of the distance between the upper joint 12 of the upper actuator and the end 2*d* of the foot section of the table top.

Moreover, the distance between the upper joint 9 of the lower actuator and the upper joint 6 of the intermediate frame is at least 1/10, preferably at least ⅛, of the distance between the upper joint 12 of the upper actuator and the end 2*d* of the foot section of the table top. The distance between the upper joint 12 of the upper actuator and the upper joint 6 of the intermediate frame is at least ⅛, preferably at least ⅙, of the distance between the upper joint 9 of the lower actuator and the end 2*c* of the head section of the table top.

The intermediate frame 4, the lower actuator 7 and the upper actuator 10 are tilted in the same direction, i.e. in all use situations they are at an angle of less than 90 to the horizontal. Hence a force acting on the foot section 2*b*, for example, causes a downward force on the lower actuator 7, i.e. a force pressing the lower actuator 7 inward. On the other hand, this type of force tends to turn the table top about the upper joint 12 of the upper actuator, thus causing a traction force on the intermediate frame 4 and the lower actuator 7. However, with the disclosed solution, this kind of force within the operating range of the patient table can be prevented. Correspondingly, a downward force on the head section 2*a* of the table top causes a force pressing the upper actuator 10 downward, although, on the other hand, it tends to turn the table top in relation to the upper joint 9 of the lower actuator, thus causing a force pulling the upper actuator 10 and the intermediate frame 4. Also this force may be avoided within the operating range of the patient table.

According to an embodiment, the actuators 7 and 10 are pushing actuators. Hence their structure is simple and reliable. With pushing actuators, inward drive, for example, takes place assisted by the table top weight.

The disclosed solution enables the pushing actuators to be kept under pressure in all situations of use. Because the actuators remain pressed, the intermediate frame 4 is subject to tension. When the actuators are under pressure all the time, there is no clearance in the operation but the actuators remain all the time in the same position with regard to clearance. It is possible to provide a corresponding solution also with pulling actuators, in which clearance can be avoided in a solution in which the lower actuator and the upper actuator produce forces acting in one direction. The actuators do not necessarily need to produce forces in one direction only, but a patient table employing two-directional actuators is also feasible.

Also in the extreme position illustrated in FIG. 4 the upper joint of the lower actuator is further away from the first end of the lower frame 3, when seen in a horizontal direction, than the lower joint 8 of the lower actuator, the upper joint 12 of the upper actuator is further away from the first end of the lower frame 3, when seen in the horizontal direction, than the lower joint 11 of the upper actuator, and the upper joint 6 of the intermediate frame is further away from the first end of the lower frame 3, when seen in the horizontal direction, than the lower joint 5 of the intermediate frame. Hence the intermediate frame 4, the lower actuator 7 and the upper actuator 10 are all tilted in the same direction. The patient table is thus sturdy and tensile stress on the actuators 7 and 10 can be avoided particularly well.

It is obvious to a person skilled in the art that as technology advances, the basic idea of the invention may be implemented in many different ways. The invention and its embodiments are thus not restricted to the examples described above but may vary within the scope of the claims.

What is claimed is:

1. A patient table including a table top, a lower frame, an intermediate frame, which is arranged between the table top and the lower frame and pivotally connected to the lower frame by a lower joint of the intermediate frame so as to turn in relation to the lower frame and to the table top by an upper joint of the intermediate frame so as to turn in relation to the table top, a lower actuator, which at its lower end is pivotally connected to the lower frame by a lower joint of the lower actuator and at its upper end to the table top or the intermediate frame by an upper joint of the lower actuator, and an upper actuator, which at its lower end is pivotally connected to the lower frame or the intermediate frame by a lower joint of the upper actuator and at its upper end to the table top by an upper joint of the upper actuator, the lower joint of the lower actuator being at a distance from the lower joint of the intermediate frame and the upper joint of the upper actuator being at a distance from the upper joint of the intermediate frame, wherein the lower joint of the intermediate frame, the lower joint of the lower actuator and the lower joint of the upper actuator are at a horizontal distance from a first end of the lower frame that is less than half of the length of the lower frame, wherein the upper joint of the lower actuator is further away from the first end of the lower frame, when seen in a horizontal direction, than the lower joint of the lower actuator, the upper joint of the upper actuator is further away from the first end of the lower frame, when seen in the horizontal direction, than the lower joint of the upper actuator, and the upper joint of the intermediate frame is further away from the first end of the lower frame, when seen in the horizontal direction, than the lower joint of the intermediate frame.

2. A patient table as claimed in claim 1, wherein the distance of the lower joint of the lower actuator from the lower joint of the intermediate frame is smaller than the length of the intermediate frame.

3. A patient table as claimed in claim 1, wherein the lower joint of the intermediate frame, the lower joint of the lower actuator and the lower joint of the upper actuator are at a horizontal distance from the first end of the lower frame that is less than one third of the length of the lower frame.

4. A patient table as claimed in claim 1, wherein the length of the intermediate frame is more than half of the length of the lower frame.

5. A patient table as claimed in claim 1, wherein the upper joint of the lower actuator is arranged to the table top and to a distance from the upper joint of the intermediate frame.

6. A patient table as claimed in claim 1, wherein the lower actuator and the upper actuator are actuators producing force in one direction.

7. A patient table as claimed in claim 6, wherein the lower actuator and the upper actuator are pushing actuators.

8. A patient table as claimed in claim 7, wherein the patient table, the lower actuator and the upper actuator are under pressure within the entire operating range of the patient table.

* * * * *